US010890070B2

(12) United States Patent
Schneider

(10) Patent No.: US 10,890,070 B2
(45) Date of Patent: Jan. 12, 2021

(54) FREE PISTON DEVICE

(71) Applicant: Deutsches Zentrum für Luft- und Raumfahrt e.V., Cologne (DE)

(72) Inventor: Stephan Schneider, Stuttgart (DE)

(73) Assignee: DEUTSCHES ZENTRUM FÜR LUFT-UND RAUMFAHRT E.V., Cologne (DE)

( * ) Notice: Subject to any disclaimer, the term of this patent is extended or adjusted under 35 U.S.C. 154(b) by 0 days.

(21) Appl. No.: 16/192,283

(22) Filed: Nov. 15, 2018

(65) Prior Publication Data

US 2019/0085694 A1 Mar. 21, 2019

Related U.S. Application Data

(63) Continuation of application No. PCT/EP2017/061495, filed on May 12, 2017.

(30) Foreign Application Priority Data

May 17, 2016 (DE) ..... 10 2016 109 038

(51) Int. Cl.
*F01B 11/00* (2006.01)
*F01P 3/02* (2006.01)
(Continued)

(52) U.S. Cl.
CPC ..... *F01B 11/007* (2013.01); *F01B 7/02* (2013.01); *F01B 11/02* (2013.01); *F01P 3/02* (2013.01);
(Continued)

(58) Field of Classification Search
CPC . F01B 11/007; F01B 7/02; F01B 11/02; F01P 3/00; F01P 3/02; F02B 71/00; F02B 71/04; F02B 75/282; F02B 63/041
See application file for complete search history.

(56) References Cited

U.S. PATENT DOCUMENTS 3,411,289 A 11/1968 Antonsen et al.
4,048,970 A 9/1977 Fitzgerald
(Continued)

FOREIGN PATENT DOCUMENTS

AU 6302199 A 6/2001
AU 4205001 A 12/2001
(Continued)

OTHER PUBLICATIONS

International Preliminary Report on Patentability for Application No. PCT/EP2017/061516, dated Nov. 20, 2018—6 pages.
(Continued)

*Primary Examiner* — Syed O Hasan

(57) ABSTRACT

A free piston apparatus includes a piston receptacle in which a piston device having a piston is reciprocable along an axis. The piston receptacle includes or forms a combustion chamber delimited by a wall arrangement forming an inlet opening for the supply of fresh gas and an outlet opening for the removal of exhaust gas. Fresh gas is suppliable via a supply conduit. The free piston apparatus includes a housing for fresh gas which is connected to the supply conduit in a flow direction of the fresh gas being supplied. The housing forms a settling chamber for fresh gas which surrounds the piston receptacle at least in sections in the region of the inlet opening in a circumferential direction of the axis. The settling chamber opens into the combustion chamber via the inlet opening.

20 Claims, 5 Drawing Sheets

(51) Int. Cl.

| | |
|---|---|
| ***F02B 71/04*** | (2006.01) |
| ***F02B 75/28*** | (2006.01) |
| ***F02B 71/00*** | (2006.01) |
| ***F01B 7/02*** | (2006.01) |
| ***F01B 11/02*** | (2006.01) |
| *F02B 75/02* | (2006.01) |
| *F02B 63/04* | (2006.01) |

(52) U.S. Cl.
CPC ..... *F02B 71/00* (2013.01); *F02B 71/04* (2013.01); *F02B 75/282* (2013.01); *F02B 63/041* (2013.01); *F02B 2075/025* (2013.01)

(56) References Cited

U.S. PATENT DOCUMENTS

| | | | | |
|---|---|---|---|---|
| 4,287,859 | A | 9/1981 | Noguchi et al. | |
| 5,002,020 | A | 3/1991 | Kos | |
| 5,893,343 | A | 4/1999 | Rigazzi | |
| 6,029,616 | A | 2/2000 | Mayne et al. | |
| 6,138,639 | A | 10/2000 | Hiraya et al. | |
| 6,748,907 | B2 | 6/2004 | Malmquist et al. | |
| 6,904,876 | B1 | 6/2005 | Hofbauer et al. | |
| 7,082,909 | B2 | 8/2006 | Gräf et al. | |
| 7,258,085 | B2 | 8/2007 | Niiyama et al. | |
| 8,887,690 | B1 | 11/2014 | Sturman | |
| 2002/0134324 | A1* | 9/2002 | Wechner | F01L 11/02 123/46 R |
| 2003/0066499 | A1 | 4/2003 | Berlinger et al. | |
| 2003/0094164 | A1 | 5/2003 | Lowi et al. | |
| 2005/0109295 | A1 | 5/2005 | Kaneko et al. | |
| 2005/0274332 | A1 | 12/2005 | Lemke et al. | |
| 2006/0042575 | A1* | 3/2006 | Schmuecker | F02B 71/04 123/46 R |
| 2006/0124083 | A1 | 6/2006 | Niiyama et al. | |
| 2006/0201456 | A1* | 9/2006 | Hofbauer | F02B 1/12 123/46 R |
| 2007/0261677 | A1 | 11/2007 | Bennion | |
| 2008/0036312 | A1* | 2/2008 | Max | F02B 1/12 123/46 R |
| 2009/0101005 | A1 | 4/2009 | Pohl et al. | |
| 2012/0112468 | A1 | 5/2012 | Najt et al. | |
| 2012/0186561 | A1 | 7/2012 | Bethel et al. | |
| 2012/0266851 | A1 | 10/2012 | Hofbauer et al. | |
| 2013/0014718 | A1 | 1/2013 | Shen et al. | |
| 2013/0098328 | A1 | 4/2013 | Hofbauer | |
| 2013/0167798 | A1 | 7/2013 | Lawler et al. | |
| 2013/0319368 | A1* | 12/2013 | Clarke | F01L 5/06 123/294 |
| 2015/0033736 | A1 | 2/2015 | Kalebjian et al. | |
| 2015/0300241 | A1 | 10/2015 | Holland | |
| 2016/0208686 | A1 | 7/2016 | Gadda et al. | |
| 2017/0204801 | A1 | 7/2017 | Sharma et al. | |
| 2017/0248099 | A1 | 8/2017 | Wagner et al. | |

FOREIGN PATENT DOCUMENTS

| | | | |
|---|---|---|---|
| AU | 2003232496 | A1 | 11/2003 |
| AU | 2003236392 | A1 | 5/2004 |
| CH | 188403 | A | 12/1936 |
| CN | 103216321 | A | 7/2013 |
| CN | 204960988 | U | 1/2016 |
| DE | 2844309 | A1 | 10/1979 |
| DE | 3103432 | A1 | 9/1982 |
| DE | 31114419 | A1 | 10/1982 |
| DE | 3047138 | A1 | 11/1982 |
| DE | 3438219 | A1 | 4/1986 |
| DE | 10219549 | B4 | 3/2004 |
| DE | 10242141 | A1 | 3/2004 |
| DE | 69817998 | T2 | 5/2004 |
| DE | 102004062440 | B4 | 9/2006 |
| DE | 102005006340 | A1 | 4/2007 |
| DE | 102005056823 | A1 | 5/2007 |
| DE | 102006029532 | A1 | 12/2007 |
| DE | 102008030633 | B4 | 4/2010 |
| DE | 102008053068 | A1 | 4/2010 |
| DE | 102008053069 | A1 | 5/2010 |
| DE | 102012111067 | B3 | 2/2014 |
| EP | 1398863 | A1 | 3/2004 |
| EP | 2224580 | A2 | 9/2010 |
| GB | 889509 | | 2/1962 |
| GB | 2334385 | A | 8/1999 |
| JP | 2013256886 | A | 12/2013 |
| WO | 9533921 | A1 | 12/1995 |
| WO | 9728362 | A1 | 8/1997 |
| WO | 9813593 | A1 | 4/1998 |
| WO | 0145977 | A2 | 6/2001 |
| WO | 0194752 | A1 | 12/2001 |
| WO | 03091556 | A1 | 11/2003 |
| WO | 2004025098 | A1 | 3/2004 |
| WO | 2007010186 | A1 | 1/2007 |
| WO | 2007085344 | A1 | 8/2007 |
| WO | 2007147789 | A1 | 12/2007 |
| WO | 2008028216 | A1 | 3/2008 |
| WO | 2009156257 | A1 | 12/2009 |
| WO | 2010046120 | A1 | 4/2010 |
| WO | 2010046121 | A1 | 4/2010 |
| WO | 2012158756 | A1 | 11/2012 |

OTHER PUBLICATIONS

International Search Report and Written Opinion for Application No. PCT/EP2017/061516, dated Aug. 9, 2017—7 pages.
International Search Report and Written Opinion for International Application No. PCT/EP2017/061510, dated Aug. 10, 2017—9 pages.
International Preliminary Report on Patentability for Application No. PCT/EP2017/061522, dated Nov. 20, 2018—8 pages.
International Search Report and Written Opinion for Application No. PCT/EP2017/061522, dated Aug. 9, 2017—9 pages.
International Preliminary Report on Patentability for International Application No. PCT/EP2017/061510, dated Nov. 20, 2018, 8 pages.
Non Final Office Action for U.S. Appl. No. 16/192,301, dated May 14, 2019, 19 pages.
Notice of Allowance for U.S. Appl. No. 16/192,291, dated Oct. 28, 2019, 19 pages.
Notice of Allowance for U.S. Appl. No. 16/192,301, dated Nov. 18, 2019, 13 pages.
International Search Report and Written Opinion for International Application No. PCT/EP2017/061495, dated Aug. 9, 2017—10 pages.
Non Final Office Action for U.S. Appl. No. 16/192,266, dated Feb. 5, 2020, 30 pages.
Chinese Office Action received in Application No. 201780028037.7 dated Sep. 16, 2020, 12 pages.

* cited by examiner

FREE PISTON DEVICE

CROSS-REFERENCE TO RELATED APPLICATIONS

This application is a continuation patent application of International Application No. PCT/EP2017/061495, filed on May 12, 2017, and claims the benefit of priority of German Application No. DE 10 2016 109 038.7, filed on May 17, 2016. The contents of International Application No. PCT/EP2017/061495 and German Application No. DE 10 2016 109 038.7 are incorporated by reference herein in their entireties and for all purposes.

FIELD

The present disclosure relates to a free piston apparatus, comprising a piston receptacle in which at least one piston device having a piston is arranged so as to be reciprocable along an axis, wherein the piston receptacle comprises or forms a combustion chamber delimited by a wall arrangement in which at least one inlet opening for the supply of fresh gas and, spaced apart therefrom in axial direction, at least one outlet opening for the removal of exhaust gas are formed, wherein fresh gas is suppliable via a supply conduit.

BACKGROUND

In a free piston apparatus of that kind, which is commonly operated in the two stroke method, the piston device oscillates back and forth in the piston receptacle. Upon the combustion of a gas-fuel-mixture in the combustion chamber, the piston is moved from a top dead center to a bottom dead center. Upon adopting the bottom dead center, the at least one inlet opening and the at least one outlet opening are opened and fresh gas supplied via the supply conduit is able to flow into the combustion chamber. Exhaust gas may be removed from the combustion chamber via at least one discharge conduit connected to the outlet opening. The piston may act as a valve body with which the at least one inlet opening upon adopting the bottom dead center is at least partially unblocked and is blocked again upon the upward movement of the piston. The upward movement of the piston occurs under the effect of a spring-back device of the free piston apparatus for the piston device. The spring-back device comprises for example a gas spring with a gas which is compressible by way of the piston device. Upon an expansion of the gas, the piston device is moved in the opposite direction for the upward movement of the piston. Alternatively or in addition, a mechanical spring-back device may be provided.

"Fresh gas" is presently to be understood as a gas or gas mixture (in particular air) for the internal combustion in the combustion chamber, wherein a fuel may also be admixed to the gas. "Fresh gas" may therefore presently also refer to a gas-fuel-mixture which may flow into the combustion chamber via the at least one entry opening. "Exhaust gas" presently refers to a combustion product of the internal combustion.

SUMMARY

An object underlying the present disclosure is to provide a free piston apparatus of the kind stated at the outset in which the supply of fresh gas is improved with respect to an optimized combustion.

In an aspect of the present disclosure a free piston apparatus comprises a piston receptacle in which at least one piston device having a piston is arranged so as to be reciprocable along an axis. The piston receptacle comprises or forms a combustion chamber delimited by a wall arrangement in which at least one inlet opening for the supply of fresh gas and, spaced apart therefrom in axial direction, at least one outlet opening for the removal of exhaust gas are formed, wherein fresh gas is suppliable via a supply conduit. The free piston apparatus comprises a housing for fresh gas which is connected to the supply conduit in flow direction of the fresh gas being supplied. The housing forms a settling chamber for fresh gas which surrounds at least in sections the piston receptacle in the region of the at least one inlet opening in circumferential direction of the axis. The settling chamber opens into the combustion chamber via the at least one inlet opening.

BRIEF DESCRIPTION OF THE DRAWINGS

The foregoing summary and the following description may be better understood in conjunction with the drawing figures, of which.

DETAILED DESCRIPTION

Figure 1:
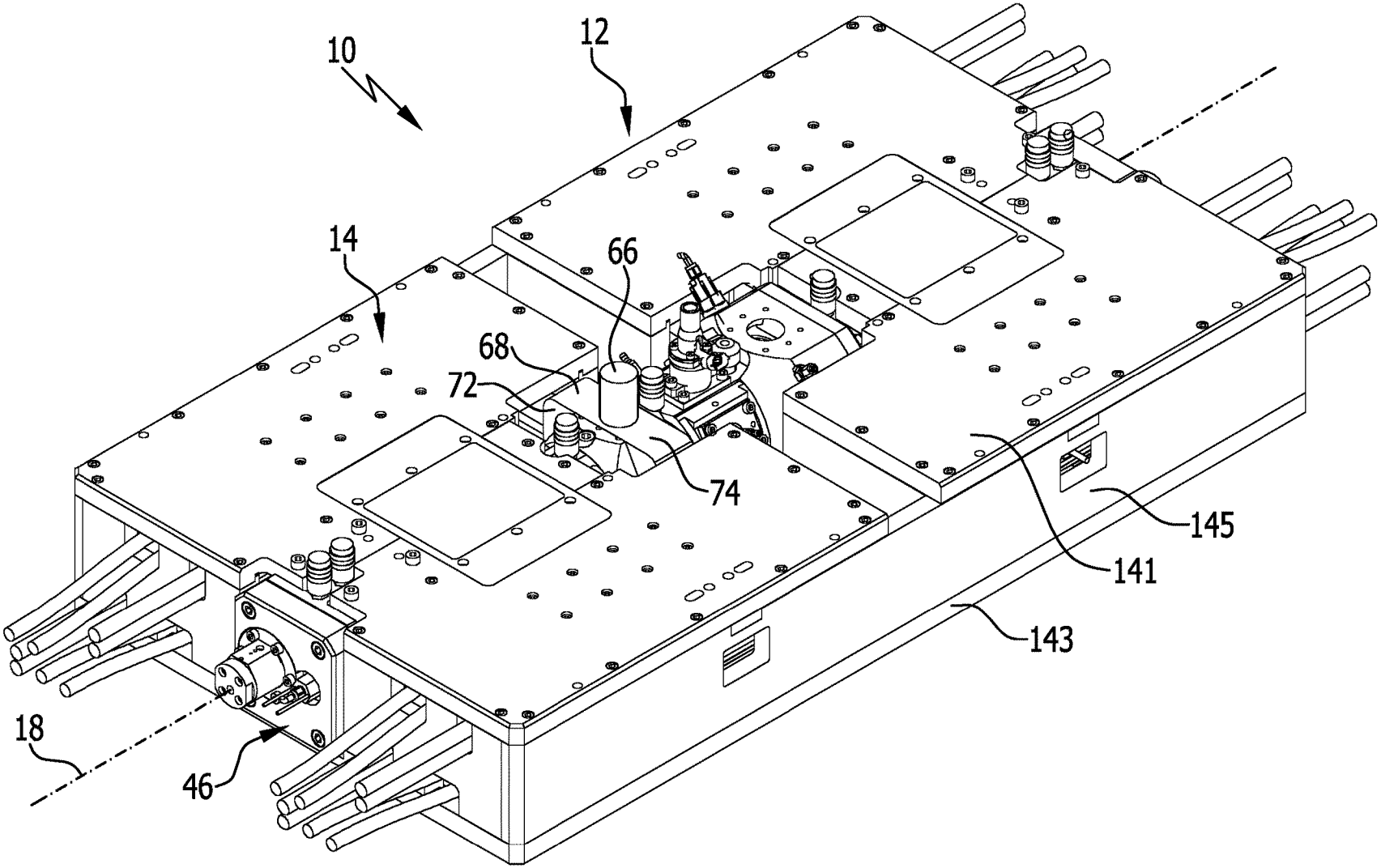
FIG. 1 shows a perspective depiction of a free piston apparatus in accordance with the present disclosure.
Figure 2:
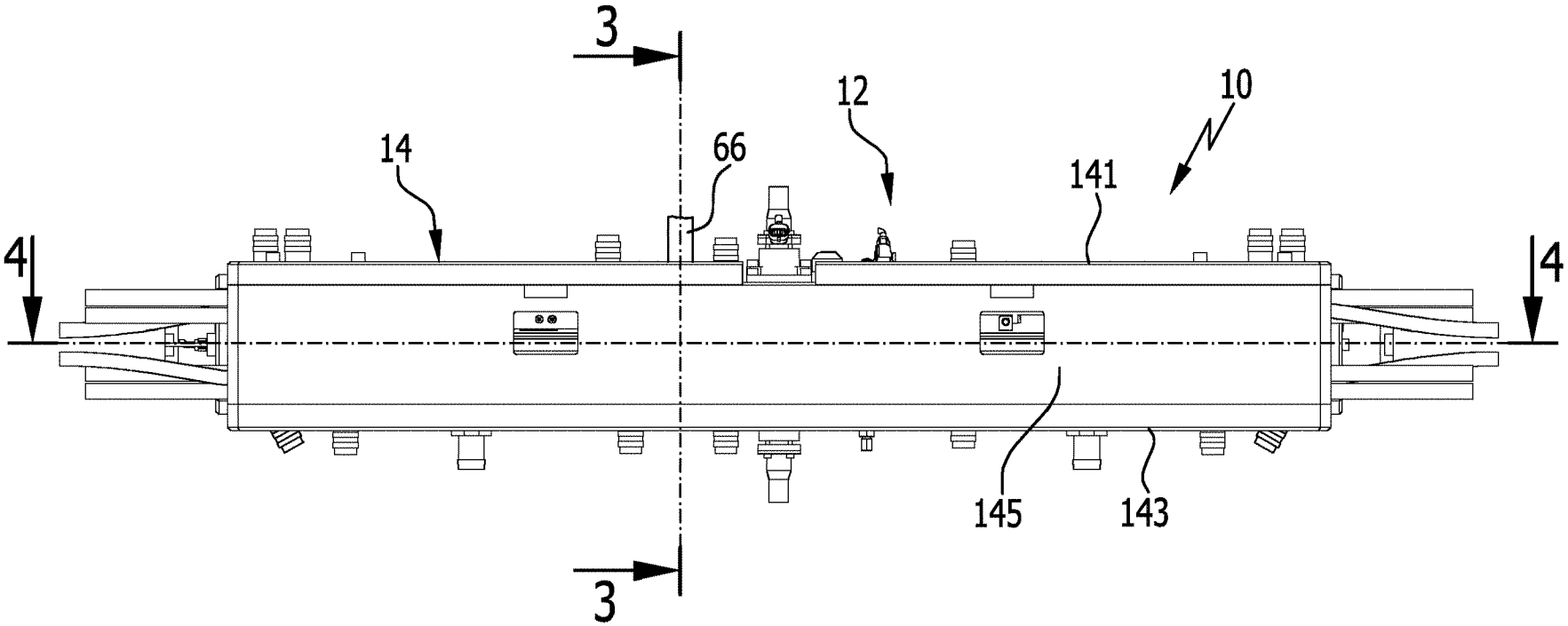
FIG. 2 shows a side view of the free piston apparatus from FIG. 1.

Although the present disclosure illustrates and describes specific embodiments, the present disclosure is not intended to be limited to the details shown. Rather, various modifications may be made in the details without departing from the present disclosure.

The present disclosure relates to a free piston apparatus, comprising a piston receptacle in which at least one piston device having a piston is arranged so as to be reciprocable along an axis, wherein the piston receptacle comprises or forms a combustion chamber delimited by a wall arrangement in which at least one inlet opening for the supply of fresh gas and, spaced apart therefrom in axial direction, at least one outlet opening for the removal of exhaust gas are formed, wherein fresh gas is suppliable via a supply conduit. The free piston apparatus comprises a housing for fresh gas which is connected to the supply conduit in flow direction of the fresh gas being supplied, wherein the housing forms a settling chamber for fresh gas which surrounds at least in sections the piston receptacle in the region of the at least one inlet opening in circumferential direction of the axis, and wherein the settling chamber opens into the combustion chamber via the at least one inlet opening.

Fresh gas being supplied via the supply conduit first enters into the settling chamber, which is formed by the housing, before entry into the combustion chamber. In the settling chamber, the flow of the fresh gas may be settled. In particular, possible pulsations and vortexes may be dampened. Only after settling does the fresh gas enter into the combustion chamber, whereby the flow condition in the combustion chamber may be better adjusted for the purpose of optimized combustion. For example, a swirl movement or a tumble movement of the fresh gas may be implemented in a better way. For this purpose, it is in particular also possible to freely adapt the geometry of the at least one inlet opening, preferably also of a plurality of inlet openings, for an inflow of fresh gas into the combustion chamber optimized with respect to the combustion.

The housing is preferably configured in such a way that the settling chamber entirely surrounds the piston receptacle in circumferential direction of the axis. In this way, a settling chamber which is as large as possible may be made available in order to settle the fresh gas before entry into the combustion chamber. Even with a plurality or multitude of inlet openings in the wall arrangement, the fresh gas entering in each case therethough is first able to be settled. The housing comprises for example a wall circulating the piston receptacle in circumferential direction of the axis.

In particular in combination with the lastly mentioned advantageous embodiment, it is favorable if the housing has through-openings through which the piston receptacle passes through the housing. For example, through-openings for the housing are provided in axial face walls, and a circulating (side) wall connects the face walls to each other. The at least one inlet opening in the wall arrangement is arranged axially between the face walls. The face walls may contact the wall arrangement laterally next to the at least one inlet opening. A sealing element may be provided on a respective through-opening, which seals between the wall arrangement and the housing.

In an advantageous implementation of the free piston apparatus in practice, it is favorable if the housing is of cuboidal or toroidal configuration. A cuboidal housing has for example a quadratic or substantially quadratic cross section in relation to the axis.

The housing is favorably configured such that the settling chamber is of annular configuration. This may presently be understood in particular in that the settling chamber entirely surrounds the wall arrangement in circumferential direction of the axis.

It proves to be advantageous if the housing is aligned coaxial to the piston receptacle. This is favorable in particular in the case of a housing fully surrounding the piston receptacle. The settling chamber extends around the entire wall arrangement of the piston receptacle. This offers the possibility of positioning and distributing inlet openings at will in circumferential direction of the axis in order to optimize the inflow of fresh gas into the combustion chamber for an advantageous combustion.

In particular in combination with the last mentioned advantageous embodiment, it is advantageous if the housing is configured in such a way that the settling chamber is formed point-symmetrical in itself with respect to the axis and/or mirror-symmetrical with respect to at least one plane of symmetry containing the axis.

The supply conduit is favorably connected to the housing transverse to the movement direction of the piston device. "Transverse" is to be understood in this context in that an axis defined by the connection of the supply conduit is aligned skewed in relation to the axis of the piston device, though a plane aligned perpendicular to the axis of the piston device contains the axis defined by the direction of the connection of the supply conduit.

It proves to be particularly advantageous if the supply conduit is connected to the housing radially with respect to the axis of the piston device.

Preferably a plurality of inlet openings is provided, wherein the settling chamber surrounds all inlet openings and opens into the combustion chamber via the same. Fresh gas, which enters into the combustion chamber via each of the inlet openings, is first settled in the settling chamber.

It proves to be favorable if the extension of the settling chamber in the housing in axial direction is smaller than the extension of the settling chamber in the housing in a direction aligned transverse to the axis. This may presently be understood in particular in that a clear measure of the housing in axial direction is less than a clear measure of the housing in a plane transverse to the axis. This is achieved for example by providing a flat housing which is of cuboidal configuration, for example, and preferably has a quadratic or substantially quadratic cross section in relation to the axis.

Provision may be made for the extension of the at least one inlet opening in axial direction to be about a fourth of the extension of the settling chamber in the housing in axial direction, preferably at least a third of the extension of the settling chamber. In an advantageous implementation, the extension of the inlet opening is about 40% of the extension of the settling chamber and in particular of the clear measure of the housing in axial direction.

It is favorable if the free piston apparatus comprises an energy coupling device which is coupled to the piston device and by way of which energy is able to be decoupled from the piston device or by way of which energy is able to be coupled into the piston device. In particular, there is the possibility of controlling the movement of the piston device by means of the energy coupling device. "Control" is presently to be interpreted as "regulating" also being meant alternatively or in addition. "Controlling" may thus presently be interpreted as "controlling and/or regulating". By the controlling of the energy coupling device, which may be carried out by a control device of the free piston apparatus, the operating point of the free piston apparatus in operation may be adjusted. For this purpose, as needed, energy may be transmitted from the energy coupling device to the piston device or energy may be removed from the piston device by way of the energy coupling device.

The energy coupling device advantageously comprises at least one linear generator. The linear generator has for example a rotor arrangement fixed on the piston device and a stator arrangement fixed on the piston receptacle or in a different manner. Rotor arrangement and stator arrangement are or comprise in particular magnets and coils, respectively.

Two linear generators with a respective rotor arrangement and a respective stator arrangement may be associated with the piston device. A respective linear generator may for example be positioned laterally next to the piston receptacle and form one of the subsequently mentioned units of the energy coupling device.

The energy coupling device is preferably positioned laterally next to the piston receptacle and the housing. As a result, a compact structural shape of the free piston apparatus may be achieved. The length of the piston receptacle from the combustion chamber via a piston rod of the piston device up to a possible spring-back device may be kept relatively short. The energy coupling device is positioned laterally next to the piston receptacle and the housing for fresh gas and, as a result, the free piston apparatus is compactly built.

In an advantageous implementation of the free piston apparatus, it is favorable if the energy coupling device comprises a first unit and a second unit which each are positioned laterally next to the piston receptacle and the housing, wherein the piston receptacle and the housing are arranged between the units of the energy coupling device. For compensating the moved masses and moments, it is favorable if the energy coupling device comprises two units, of which each, for example as mentioned above, is formed by a linear generator. The piston receptacle and the housing are positioned between the units. As a result, only relatively little construction space is taken up for the housing, because a space between the units which is required anyway may be utilized. The free piston apparatus may be built compactly.

In particular in combination with the lastly mentioned advantageous embodiment, it is favorable if the housing is arranged entirely or substantially entirely within an outer contour of a housing of the free piston apparatus accommodating the energy coupling device, wherein the piston receptacle is preferably also positioned within the outer contour. For example, the housing of the free piston apparatus accommodates the energy coupling device which is arranged at least on one side laterally next to the piston receptacle and the housing for fresh gas. Transverse thereto, as well as transverse to the axis, the housing for fresh gas may be arranged within the outer contour of the housing of the free piston apparatus, preferably the piston receptacle as well. The housing for fresh gas favorably projects in no spatial direction beyond the outer contour of the housing of the free piston apparatus, or only insignificantly, for example with a connecting element for the supply conduit.

Transverse to the axis and transverse to the direction in which the energy coupling device, especially its units, is/are arranged laterally next to the piston receptacle and the housing for fresh gas, the housing for fresh gas may preferably entirely or substantially entirely utilize the construction space of the free piston apparatus. The housing for fresh gas preferably does not project beyond the outer contour of the housing of the free piston apparatus, but advantageously utilizes the construction space within the outer contour as much as possible. With a compact structural shape of the free piston apparatus, a space within the outer contour which is as large as possible may be used as a settling chamber for the fresh gas.

The housing of the free piston apparatus may comprise an upper wall, a lower wall, and a circulating side wall and may preferably be configured as flat housing.

The piston receptacle may comprise a housing and a piston bushing which is inserted into the housing and comprises or forms the wall arrangement. The piston may be reciprocable in the piston bushing and the at least one inlet opening and preferably the at least one outlet opening may be formed in the piston bushing. The piston bushing is in particular a cylinder bushing.

The piston is favorably movable at least partially over the at least one inlet opening, wherein the latter is at least partially unblockable upon the piston adopting the bottom dead center. In this way, the piston may form a valve body for the at least one inlet opening. A separate valve may be dispensed with. At the bottom dead center of the piston, fresh gas may flow out of the settling chamber through the at least one inlet opening for scavenging the combustion chamber.

The free piston apparatus preferably comprises a further piston device having a piston, wherein the pistons of both piston devices are positioned in opposed piston arrangement, wherein the combustion chamber is formed between the pistons. As a result of the opposed piston arrangement, a compensation of the moved masses and moments may preferably be achieved. The piston devices thereby oscillate opposite to each other in the piston receptacle. The combustion chamber is formed variable in size between the pistons as a result of the opposing movement of the piston devices.

The free piston apparatus may comprise a further spring-back device which is associated with the further piston device. The spring-back device may comprise a gas spring and/or be of mechanical configuration.

An energy coupling device may also be associated with the further piston device, which energy coupling device is preferably positioned laterally next to the piston receptacle. The energy coupling device may comprise a linear generator. For example, two units of the further energy coupling device which in each case are positioned laterally next to the piston receptacle are provided. Each unit may be formed by a linear generator.

The piston of the further piston device is preferably movable at least partially over the at least one outlet opening, wherein the latter is at least partially unblockable upon the piston adopting the bottom dead center. As a result, the piston may form a valve body for the at least one outlet opening. A separate valve may be dispensed with. At the bottom dead center of the piston, exhaust gas is able to flow out of the combustion chamber through the at least one outlet opening.

In a different embodiment of the free piston apparatus, (exactly) one piston device may be provided. Preferably at least one valve which is controllable by a control device of the free piston apparatus for unblocking or blocking the at least one outlet opening is arranged on the at least one outlet opening. By way of the at least one valve, the control device is able to unblock the at least one outlet opening and thereby carry out the charge exchange. The at least one outlet opening is arranged on the wall arrangement of the combustion chamber for example on the face side and is opposite a piston face of the piston.

The drawing shows an advantageous embodiment of a free piston apparatus in accordance with the present disclosure, which is applied with the reference numeral 10, which in particular forms a free piston motor 12.

The free piston apparatus 10 comprises an outer housing 14 which is presently cuboidal and is configured as flat housing. The housing 14 comprises an upper wall 141, a lower wall 143, and a circulating side wall 145, and defines an outer contour of the free piston apparatus 10. The walls 141, 143, and 145 enclose a receiving space 147.

Figure 3:
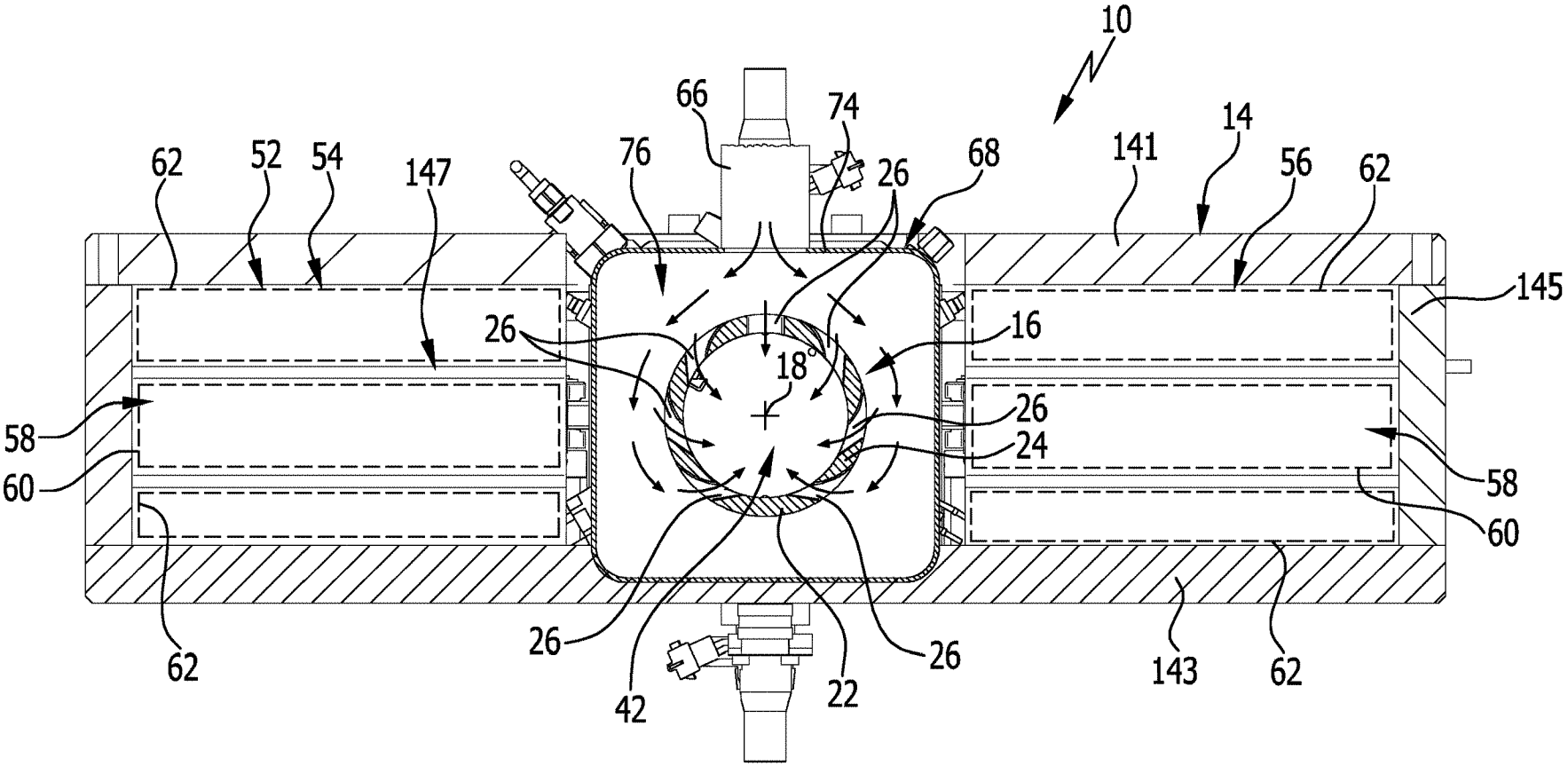
FIG. 3 shows a sectional view along the line 3-3 in FIG. 2.
Figure 4:
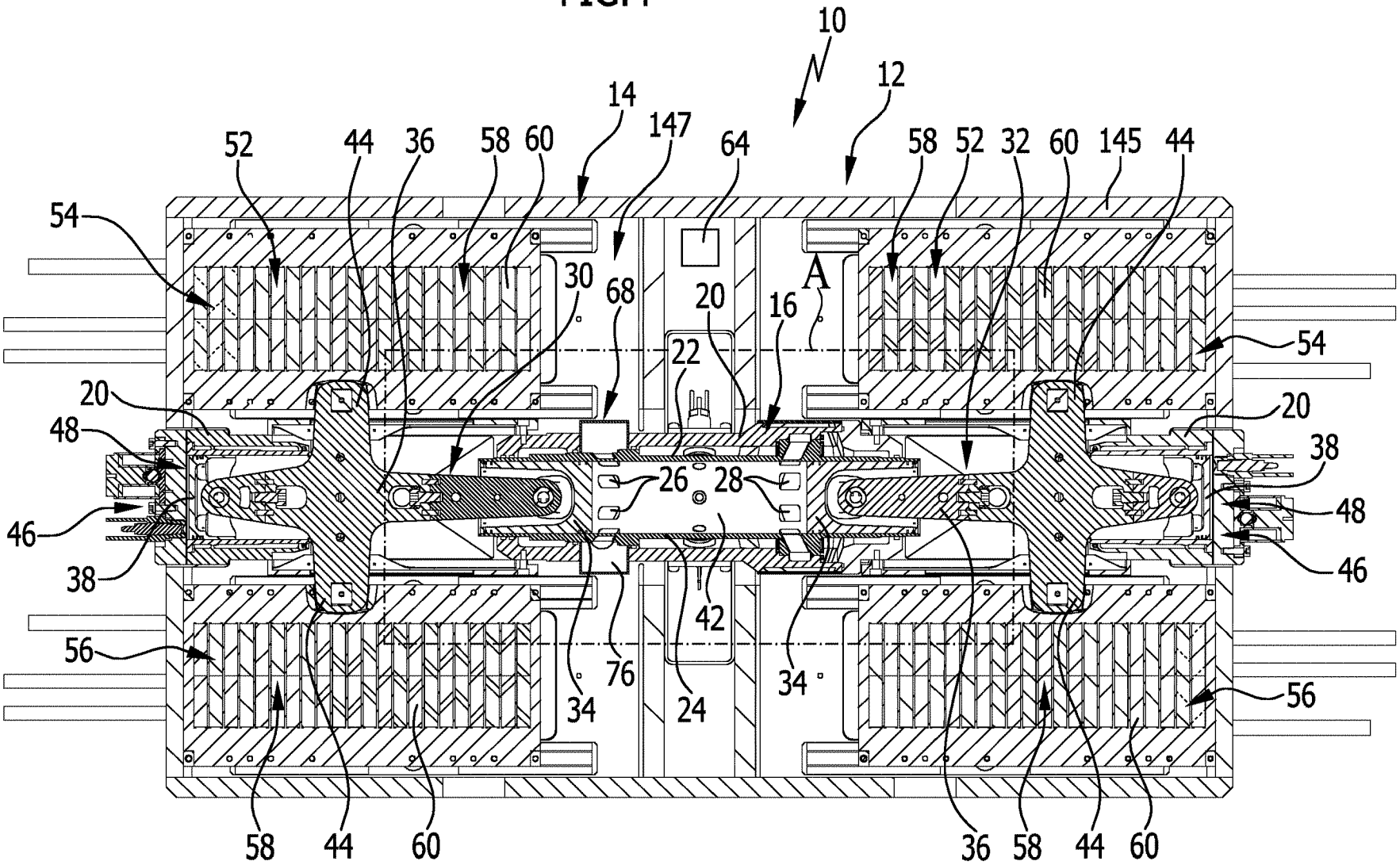
FIG. 4 shows a sectional view along the line 4-4 in FIG. 2.
Figure 5:
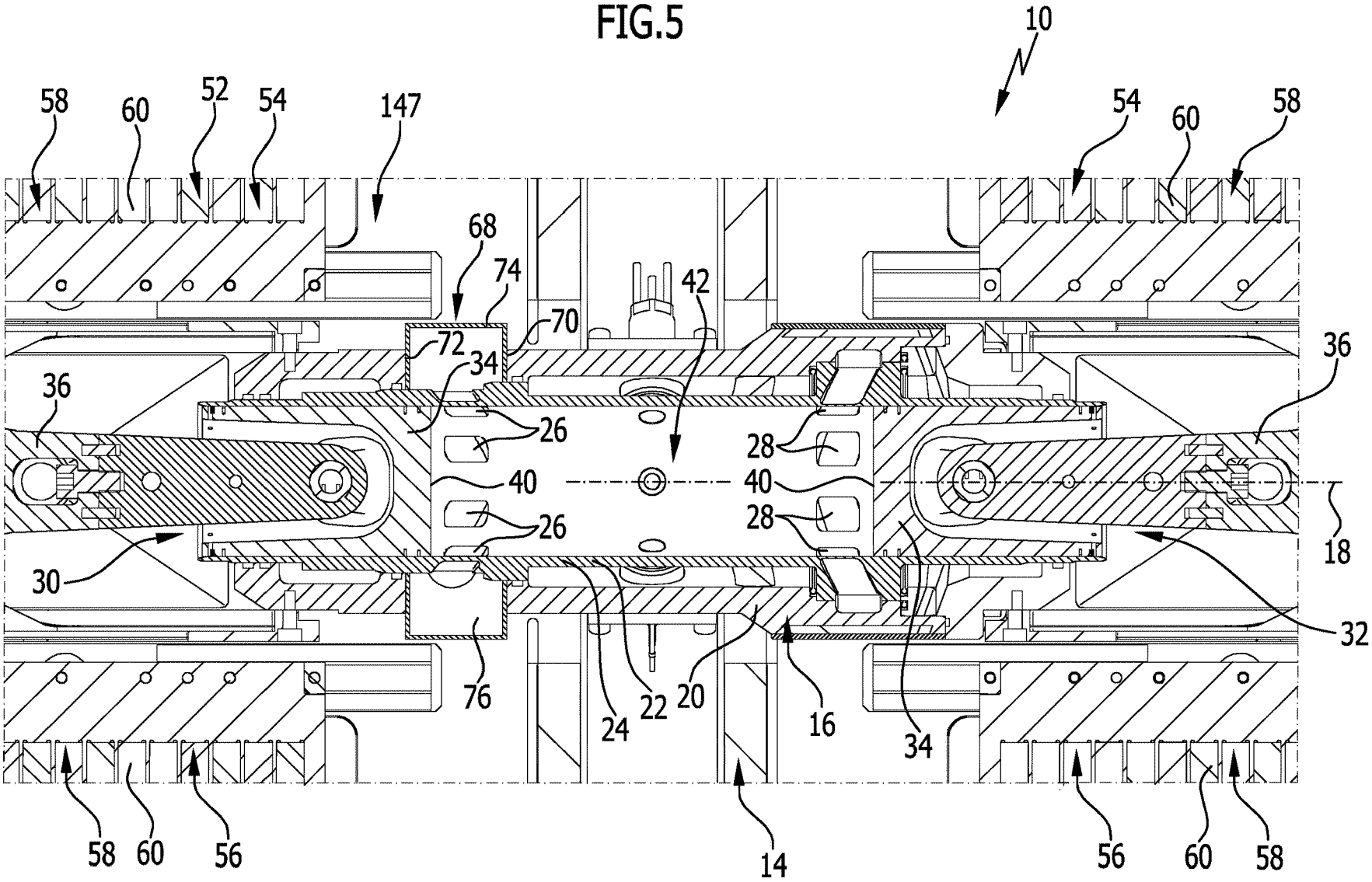
FIG. 5 shows an enlarged depiction of detail A in FIG. 4.

A piston receptacle 16 is arranged in the receiving space 147. The piston receptacle 16 is longitudinally extended and defines an axis 18 of the free piston apparatus 10. The piston receptacle 16 has a housing 20 of approximately hollow-cylindrical shape which is divided into individual sections. A piston bushing 22 of the piston receptacle 16 is arranged in the housing 20. The piston bushing 22 is substantially of hollow-cylindrical configuration and is inserted into a middle section of the housing 20 (FIGS. 3 to 5).

Openings are formed in a wall arrangement 24 of the piston bushing 22 and thus the piston receptacle 16. The openings comprise inlet openings 26 on the one hand and outlet openings 28 on the other. Presently, in each case seven inlet openings 26 and outlet openings 28 are present, wherein their respective count may also be different.

The inlet openings 26 are axially spaced apart from the outlet openings 28. "Axial" and "radial" presently refer to the axis 18.

The respective inlet openings 26 are formed at substantially the same position in the wall arrangement 24 in circumferential direction of the axis 18. The same applies to the outlet openings 28. The inlet openings 26 and the outlet openings 28 are, e.g., of slit-shaped or shaft-shaped configuration.

The free piston apparatus 10 comprises two piston devices 30, 32. The piston devices 30, 32 are arranged in the piston receptacle 16 so as to be axially reciprocable. Each piston device 30, 32 has a (combustion) piston 34, a piston rod 36, and an opposed piston 38. The pistons 34 each comprise a piston face 40 and are positioned in opposed piston arrangement, wherein the piston faces 40 face toward each other.

The piston receptacle 16 comprises a combustion chamber delimited by the wall arrangement 24. The combustion chamber 42 is variable in size as a result of the opposing movement of the piston devices 30, 32 and is formed between the piston faces 40.

The piston rod 36 connects the piston 34 to the opposed piston 38, wherein presently both pistons 34, 38 are tiltingly held on the piston rod 36. However, a rigid connection is also conceivable. Transverse to the axis 18, projections 44 protrude from the piston rod 36 on opposing sides. The projections 44 emerge from the housing 20. The piston rod 36 thereby has a roughly cruciform shape (FIG. 4).

The free piston apparatus 10 comprises a spring-back device 46 associated with each piston device 30, 32. The spring-back device 46 presently comprises a gas spring 48 having a spring-back space. The spring-back space is formed by the housing 20 and is arranged thereon at the end.

If the piston devices 30, 32 move from the top dead center to the bottom dead center as a result of the combustion in the combustion chamber 42, then a gas in the spring-back space is compressed by the opposed piston 38 until the piston 34 adopts its bottom dead center (depicted in FIG. 4). Upon the expansion of the gas in the spring-back space, the respective piston device 30, 32 is again displaced in the opposite direction.

The free piston apparatus 10 has two energy coupling devices 52, wherein an energy coupling device 52 is associated with each piston device 30, 32. The energy coupling devices 52 are arranged in the receiving space 147. Each energy coupling device 52 comprises a first unit 54 and a second unit 56. The units 54, 56 are each positioned laterally next to the piston receptacle 16, but on opposing sides thereof. Both units 54, 56 define a common plane in which the piston receptacle 16 is arranged.

Each unit 54, 56 is formed by a linear generator 58 with a rotor arrangement 60 and a stator arrangement 62. The rotor arrangement 60 is connected to the piston rod 36 by way of the projection 44 and is displaceably guided in the housing 14 parallel to the axis 18. The rotor arrangement 60 comprises magnets. In the drawing, the stator arrangement 62 comprises coils which are not individually depicted and are arranged above and beneath the rotor arrangement 60.

FIG. 3 shows the contours of the rotor arrangements 60 and the stator arrangements 62 of two units 54, 56. Because the piston 34 in the drawing adopts the bottom dead center, the sectional view presently does not run through the rotor arrangements 60, which are displaced and cross the sectional plane only upon the (imagined) upward movement of the piston 34.

By way of the energy coupling device 52, there is the possibility of coupling energy into the piston device 30 or 32 and to remove energy therefrom, respectively. This allows for controlling the movement of the piston device 30 or 32 in the operation of the free piston apparatus 10. For this purpose, the energy coupling devices 52 are controllable by a control device 64 of the free piston apparatus 10 (FIG. 4).

The free piston apparatus 10 presently works according to the two stroke method. A combustion in the combustion chamber 42 drives the pistons 34 apart from each other commencing from the top dead center, such that they are axially displaced in the piston bushing 22. The displacement occurs up to a respective bottom dead center of the pistons 34. When the pistons 34 adopt the bottom dead center, then the inlet openings 26 are unblocked by the piston 34 of the piston device 30, and the outlet openings 28 are unblocked by the piston 34 of the piston device 32. This is depicted in FIGS. 4 and 5.

Upon the charge exchange, when the inlet openings 26 and the outlet openings 28 are unblocked, the combustion chamber 42 is scavenged. Fresh gas flows via the inlet openings 26 into the combustion chamber 42. Exhaust gas is able to be removed from the combustion chamber 42 via the outlet openings 28. A uniflow scavenging of the combustion chamber 42 via openings 26, 28 which are axially spaced apart from each other is performed.

"Fresh gas" is presently a gas or a gas mixture (in particular air) for the internal combustion. A fuel may be admixed to the supplied fresh gas. Alternatively or in addition, provision may be made for a fuel to be admixed by way of an injection device to the fresh gas flowing into the combustion chamber 42. The ignition of the charge may occur by means of an ignition device which is controllable by the control device 64. An auto-ignition is also conceivable, depending on the mixture ratio of fresh gas and exhaust gas.

In the free piston apparatus 10 in accordance with the present disclosure, the supply of fresh gas occurs via a supply conduit 66, which is shown to some extent in the drawing. Arranged downstream in flow direction of the fresh gas, the free piston apparatus 10 has a housing 68 for fresh gas. The supply conduit 66 is connected to the housing 68 at the entry side.

The housing 68 is presently box-shaped with axial face walls 70, 72 and a side wall 74 running in circumferential direction of the axis 18. The housing 68 hereby has a roughly cuboidal shape. A cross section of the housing 68 perpendicular to the axis 18 is substantially quadratic (FIG. 3). The housing 68 is aligned coaxial to the piston receptacle 16 and in particular to its piston bushing 22.

The piston receptacle 16, by means of the piston bushing 22, passes through the housing 68 in axial direction through through-openings formed in the face walls 70, 72. The housing 68 surrounds the piston bushing 22 in the region of the inlet openings 26 thereby entirely in circumferential direction of the axis 18. The face walls 70, 72 contact the wall arrangement 24.

The housing 68 defines a settling chamber 76 for fresh gas, which entirely surrounds the piston bushing 22 in circumferential direction of the axis 18 and opens into the combustion chamber 42 via the inlet openings 26 (FIGS. 3 and 5). The housing 68 and the settling chamber 76 have a point-symmetry with respect to the axis 18. A mirror-symmetry of the housing 68 and the settling chamber 76 with respect to four planes of symmetry containing the axis 18 is also present.

Fresh gas, which enters into the housing 68 via the supply conduit 66, may expand in the settling chamber 76. Pulsations and turbulence are dampened. It shows that the inflow of fresh gas through the inlet openings 26 is optimized with respect to a combustion in the combustion chamber 42 by providing the housing with the settling chamber 76.

For this purpose, it is particularly advantageous for the housing 68 and the settling chamber 76 to entirely surround the piston bushing 22. The inlet openings 26 may be formed in their geometry for an optimal introduction of fresh gas into the combustion chamber 42. Fresh gas is able to entirely flow around the piston bushing 22 in the settling chamber 22, but thereby still be settled.

The housing 68 is a flat housing, wherein the extension of the settling chamber 76 in axial direction is significantly less than the extension in a plane transverse to the axis 18. It is also favorable for the extension of the inlet openings 26 in relation to the axial extension of the settling chamber 76 to have a not inconsiderable size. This ratio is presently about 40%. Inflowing fresh gas thus forms substantially no turbulence with movement in axial direction, but rather, in addition to the settling, is supplied to the inlet openings 26 in a targeted manner laterally past the piston bushing 22.

For this purpose, it is also advantageous for the supply conduit 66 to be connected to the housing 68 in radial direction. As a result, the stream of fresh gas may be divided into two partial streams which flow around the piston bushing 22 in opposite directions (FIG. 3).

The free piston apparatus 10 has a compact structural shape. The housing 68 is also positioned transverse to the axis 18 between the units 54, 56 of the energy coupling device 52, like the piston receptacle 16 (FIGS. 3 and 4). The construction space between the units 54, 56 which is required anyway is thus optimally used.

The housing 68 is also arranged entirely within the outer contour of the housing 14 of the free piston apparatus 10, except for the connection of the supply conduit 66 (FIGS. 1 and 3). The units 54, 56 are positioned laterally next to the housing 68 and, in a transverse direction thereto and transverse to the axis 18, the housing 68 remains within the outer contour defined by the housing 14 in which the units 54, 56 are accommodated.

Vice versa, the housing 68 projects up to the upper wall 141 and the lower wall 132 and thus nearly up to the outer contour of the housing 14. The height of the housing 14 is thereby utilized as much as possible for the housing 68, in order to utilize a settling chamber 76 for the fresh gas which is as large as possible.

REFERENCE NUMERALS

10 free piston apparatus
12 free piston motor
14 housing
16 piston receptacle
18 axis
20 housing
22 piston bushing
24 wall arrangement
26 inlet opening
28 outlet opening
30 piston device
32 piston device
34 piston
36 piston rod
38 opposed piston
40 piston face
42 combustion chamber
44 projection
46 spring-back device
48 gas spring
52 energy coupling device
54 unit
56 unit
58 linear generator
60 rotor arrangement
62 stator arrangement
64 control device
66 supply conduit
68 housing
70 face wall
72 face wall
74 side wall
76 settling chamber
141 upper wall
143 lower wall
145 side wall
147 receiving space

The invention claimed is:

1. A free piston apparatus comprising:

an apparatus housing having an upper wall, a lower wall and a circulating side wall defining an outer contour;

a piston receptacle defining an axis and comprising or forming a combustion chamber delimited by a wall arrangement with at least one inlet opening for the supply of fresh gas and, spaced apart therefrom in the axial direction, at least one outlet opening for the removal of exhaust gas being formed in the wall arrangement;

at least one piston device having a piston being arranged so as to be reciprocable along the axis;

a supply conduit for supplying fresh gas;

a housing which is connected to the supply conduit in flow direction of the fresh gas being supplied, the housing forming a settling chamber for fresh gas which surrounds at least in sections the piston receptacle in the region of the at least one inlet opening in circumferential direction of the axis, the settling chamber opening into the combustion chamber via the at least one inlet opening; and an energy coupling device which is coupled to the piston device and by way of which energy is able to be decoupled from the piston device or by way of which energy is able to be coupled into the piston device, the energy coupling device being accommodated in the apparatus housing, wherein the housing is arranged entirely or substantially entirely within the outer contour defined by the apparatus housing, with the apparatus housing being a flat housing, and the energy coupling device being positioned laterally next to the piston receptacle and the housing.

2. The free piston apparatus according to claim 1, wherein the housing is configured such that the settling chamber entirely surrounds the piston receptacle in circumferential direction of the axis.

3. The free piston apparatus according to claim 1, wherein the housing has through-openings through which the piston receptacle axially passes through the housing.

4. The free piston apparatus according to claim 1, wherein the housing is of cuboidal or toroidal configuration.

5. The free piston apparatus according to claim 1, wherein the housing is configured such that the settling chamber is of annular configuration.

6. The free piston apparatus according to claim 1, wherein the housing is aligned coaxial to the piston receptacle.

7. The free piston apparatus according to claim 1, wherein the housing is configured such that the settling chamber is formed point-symmetrical in itself with respect to the axis and/or mirror-symmetrical with respect to at least one plane of symmetry containing the axis.

8. The free piston apparatus according to claim 1, wherein the supply conduit is connected to the housing transverse to the movement direction of the piston device.

9. The free piston apparatus according to claim 1, wherein the supply conduit is connected to the housing radially with respect to the axis.

10. The free piston apparatus according to claim 1, wherein a plurality of inlet openings is provided and wherein the settling chamber surrounds all inlet openings and opens into the combustion chamber via the same.

11. The free piston apparatus according to claim 1, wherein the extension of the settling chamber in the housing in axial direction is smaller than the extension of the settling chamber in the housing in a direction aligned transverse to the axis.

12. The free piston apparatus according to claim 1, wherein the extension of the at least one inlet opening in axial direction is about at least a fourth of the extension of the settling chamber in the housing in axial direction, preferably at least a third of the extension of the settling chamber.

13. The free piston apparatus according to claim 1, wherein the energy coupling device comprises at least one linear generator.

14. The free piston apparatus according to claim 1, wherein the energy coupling device comprises a first unit and a second unit which each are positioned laterally next to the piston receptacle and the housing, wherein the piston receptacle and the housing are arranged between the units of the energy coupling device.

15. The free piston apparatus according to claim 1, wherein the piston receptacle is also positioned within the outer contour.

16. The free piston apparatus according to claim 1, wherein the piston receptacle comprises a housing and a piston bushing which is inserted into the housing and comprises or forms the wall arrangement, wherein the piston is reciprocable in the piston bushing and the at least one inlet opening is formed in the piston bushing.

17. The free piston apparatus according to claim 1, wherein the piston is movable at least partially over the at least one inlet opening and wherein the latter is at least partially unblockable upon the piston adopting the bottom dead center.

18. The free piston apparatus according to claim 1, wherein the free piston apparatus comprises a further piston device having a piston, wherein the pistons of both piston devices are positioned in opposed piston arrangement, wherein the combustion chamber is formed between the pistons.

19. The free piston apparatus according to claim 18, wherein the piston of the further piston device is movable at least partially over the at least one outlet opening and wherein the latter is at least partially unblockable upon the piston adopting the bottom dead center.

20. The free piston apparatus according to claim 1, wherein one piston device is provided, wherein at the at least one outlet opening is arranged at least one valve which is controllable by a control device of the free piston apparatus for unblocking or blocking the at least one outlet opening.

* * * * *